US007797126B2

(12) United States Patent
Wenzel et al.

(10) Patent No.: US 7,797,126 B2
(45) Date of Patent: Sep. 14, 2010

(54) ONLINE DETERMINATION OF THE QUALITY CHARACTERISTICS FOR PUNCH RIVETING AND CLINCHING

(75) Inventors: Andreas Wenzel, Bielefeld (DE); Adnan Kolac, Bielefeld (DE)

(73) Assignee: Bollhoff Verbindungstechnik GmbH, Bielefeld (DE)

( * ) Notice: Subject to any disclaimer, the term of this patent is extended or adjusted under 35 U.S.C. 154(b) by 425 days.

(21) Appl. No.: 12/014,512

(22) Filed: Jan. 15, 2008

(65) Prior Publication Data

US 2008/0177512 A1 Jul. 24, 2008

(30) Foreign Application Priority Data

Jan. 18, 2007 (EP) ..... 07001042

(51) Int. Cl.
*G01B 5/02* (2006.01)
*B23P 19/00* (2006.01)
*F16B 15/00* (2006.01)
*F16B 19/08* (2006.01)

(52) U.S. Cl. ..... 702/158; 29/798; 403/283; 411/501

(58) Field of Classification Search ..... 702/158, 702/33, 41, 85, 94–95, 97, 105, 127, 150–153, 702/155–157, 166–170, 182–183, 188–189; 703/1, 7; 33/1 M, 503, 520, 559–560, 627, 33/644–645, 700–701, 710; 700/174–175, 700/192, 206; 29/34 B, 34 R, 243.53, 281.5, 29/283.5, 798; 411/501; 403/274, 279–280, 403/282–283, 285; 72/352, 363, 379.2
See application file for complete search history.

(56) References Cited

U.S. PATENT DOCUMENTS 6,067,696 A * 5/2000 Cecil et al. ..... 29/407.01
6,219,898 B1 * 4/2001 Kubanek et al. ..... 29/525.06
6,543,115 B1 * 4/2003 Mauer et al. ..... 29/407.05
7,123,982 B2 * 10/2006 Mauer et al. ..... 700/175
7,160,047 B2 * 1/2007 Mueller et al. ..... 403/283
7,409,760 B2 * 8/2008 Mauer et al. ..... 29/715
7,559,133 B2 * 7/2009 Chitty et al. ..... 29/716
2005/0081360 A1 4/2005 Blocher et al.
2006/0207079 A1 9/2006 Mauer et al.

FOREIGN PATENT DOCUMENTS

DE 103 27 886 A1 1/2005
EP 1 459 819 A2 2/2004

OTHER PUBLICATIONS

Lin, H. C., Development of Monitoring and Control Precise Riveting system Using Wireless Internet, 2006 IEEE, pp. 4420-4424.*
Varis et al., A Simple Testing-Based Procedure and Simulation of the Clinching Process Using Finite Element Analysis for Establishing Clinching Parameters, 2003, Thin-Walled Structures 41, pp. 691-709.*

* cited by examiner

*Primary Examiner*—Michael P Nghiem
*Assistant Examiner*—Toan M Le
(74) *Attorney, Agent, or Firm*—Seyfarth Shaw LLP

(57) ABSTRACT

The present invention discloses a method for the online determination of a bulge/upset dimension $x_{ST}$ and rivet head end position K of a rivet 3 with a length L in a punch rivet process with the help of a moveable punch 10 and a rigid die 20. The path covered by the punch 10 and the force applied by it are determined and evaluated online during the joining process. The quality characteristics of the joint connection are determined with the help of defined threshold values or a graphical evaluation of force/path data of the joining process.

12 Claims, 6 Drawing Sheets

Figure 1:
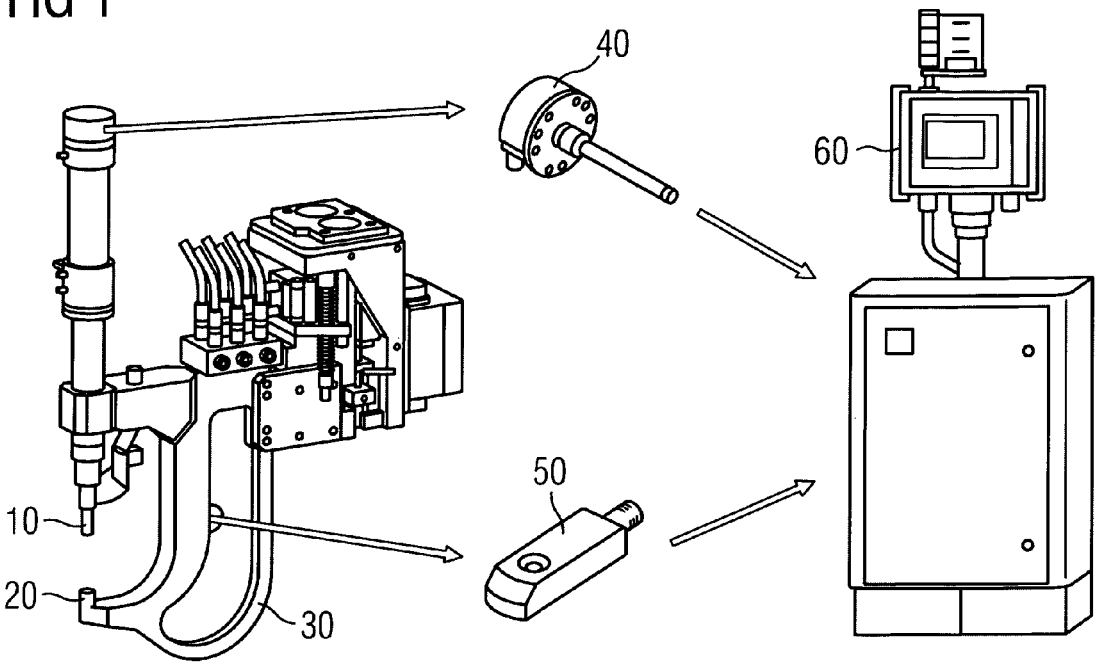

ONLINE DETERMINATION OF THE QUALITY CHARACTERISTICS FOR PUNCH RIVETING AND CLINCHING

FIELD OF THE INVENTION

The present invention relates to an online determination of the bulge/upset dimension and the rivet head end position of a rivet in a punch rivet process.

BACKGROUND OF THE INVENTION

Punch riveting is a joining process performed with rivet elements. These rivet elements comprise full punch rivets and half-hollow punch rivets.

After the punch riveting, the punch rivet connection undergoes a quality check. One differentiates hereby between a non-destructive and a destructive quality check. Visual inspection, the check of the outer joint geometry and the process monitoring are commercially used as means for the non-destructive quality check. However, visual inspection only provides general conclusions about a produced punch rivet connection, since only outer characteristics of the punch rivet connection are available. In the case of a connection with half-hollow punch rivets, these include for example the concision of the rivet head, the state of the die-side sheet, damage to joining component surfaces by the hold-down device and the alignment of the rivet with respect to the die.

Even in the case of the check of the outer joining element geometry, only the variables of the produced joint connection visible from the outside are available. These are the rivet head end position, the bulge/upset dimension during punch riveting with half-hollow punch rivet and the embossing depth during punch riveting with full punch rivet.

Process monitoring based on the force/path data of the joining process is also used for the quality check. The force/path curve of a produced optimal joint connection is used as the reference curve for the evaluation of the joining processes. Envelopes, tolerance bands or process windows are placed around this reference curve in order to be able to determine a deviation of the force/path data from the reference curve during a joining process.

Another alternative for the quality check is the aforementioned destructive check of the produced joint connection. For the destructive quality check, macro grindings of the joint connection are prepared and/or strength tests of the joint connection are performed. An evenness of the joint parts in the joint zone, a seam formation between the joint parts, a concision of the rivet head with a punch-side sheet, an undercut formation and a lack of cracks in the joint connection can be evaluated from a macro grinding. The mentioned strength test enables conclusions about the bearing capacity of the punch rivet connection under shear, peel and head-pull stresses.

In practice, the joint parameters and the geometric variables for the joint connection are normally determined in preliminary tests. On this basis, the rivet head end position and the bulge/upset dimension of an optimal joint connection are taken as the reference variables, since they can be determined in a non-destructive manner. The effort of the destructive quality check is thereby reduced. But these reference variables must also be measured individually after each joining process. This is associated with a lot of time and is not suitable for series production. Another alternative is the random-like check of the above reference variables.

Thus, the object of the present invention is to provide a method for checking the quality characteristics of the joint connections, which is improved compared to the state of the art.

SUMMARY OF THE INVENTION

The above object is solved through the method according to independent patent claim 1. Further developments and advantageous embodiments of the present invention result from the following description, the accompanying drawing and the attached patent claims.

The method according to the invention discloses an online determination of the bulge/upset dimension $x_{ST}$ and rivet head end position $K_{HS}$ of a half-hollow punch rivet with a length L in a punch rivet process with the help of a moveable punch of a rigid die. The online determination has the following steps: capturing of a path covered by a moveable punch during the punch rivet process by means of a travel sensor, capturing of a force applied to the half-hollow punch rivet by the moveable punch during the punch rivet process depending on the covered path, determination of an attachment point $x_2$ of the rivet on a joint part and a release point $X_4$, which identifies a release of the punch after the punch rivet process, from the captured force/path data and calculation of the rivet head end position $K_{HS}$ in accordance with $K=x_2+L-x_4$ and the bulge/upset dimension $x_{ST}$ in accordance with $x_{ST}=x-x_4$, while x describes the maximum distance between facing sides of the punch and die.

The present invention is based on the capturing and evaluation of force/path data for each individual joining process. During the punch rivet process, the path covered by the punch, on one hand, and the force applied to the half-hollow punch rivet, on the other hand, are recorded and evaluated together. If one presents the captured force/path data of the punch rivet process as a curve in a force/path diagram, relevant variables can be derived for the calculation of the bulge/upset dimension $x_{ST}$ and the rivet head end position $K_{HS}$ from this representation or already from typical changes in the force/path data without curve representation. The attachment point $x_2$ of the half-hollow punch rivet on the joint part can be seen for example in the force/path data via a detection of a missing change in the captured moveable path of the die despite a punch infeed. In accordance with another alternative, the attachment point $x_2$ in the force/path data can be identified as the path, on which the captured force exceeds a holding force of a set head or hold-down device by a certain threshold value. If no set head or hold-down device is used, it is also conceivable to have the threshold value follow any other initial force value.

The captured force/path data is captured and evaluated in accordance with an embodiment in a data processing unit, in particular in a computer. For this purpose, the data from the travel sensor and the force sensor is transferred to the data processing unit for example directly or via an analog/digital converter.

It is furthermore preferred to calculate a reference variable $\Delta x_C$ for a machine rigidity/compliance of the joining machine in accordance with $\Delta x_C=x_3-x_4$. This reference variable specifies the flexibility of the constructive connection between the punch and die. For example, if the punch rivet process is performed with the help of a C frame, it can be determined from the reference variable $\Delta x_C$ whether material fatigue is the result of joint process in the C frame. For the calculation of this reference variable from the force/path data, point $x_3$ is captured as the path, in which the maximum force $F_{max}$ of the punch is achieved during the joint process.

In accordance with another embodiment, the force path data of the joint process is represented as a curve in a force/path diagram. After the maximum force of the punch $F_{max}$ has been reached, the punch is moved back, which leads to a mechanical release of the punch and the rivet connection. This returning of the punch is called a return in the force/path data of the joint process. Immediately after the maximum force $F_{max}$ of the punch is reached, the return shows an approximately linear progression at the beginning. A point $x_4$ can be identified within this return, in that one creates a tangent on the almost linear running force/path data at the beginning of the return so that a deviation of the force/path data by a specified value from the tangent specified point $x_4$.

With the capturing of the force/path data during the joining process and the immediate evaluation in the computer, an online determination of the bulge/upset dimension $x_{ST}$ and the rivet head end position $K_{HS}$ is thus performed as a quality check. Process capability examinations are performed and quality control charts are written with these automatically documented quality variables. Furthermore, conclusions can be made about geometric variables and load-bearing behavior of the achieved joint connection, which previously could only be determined through the destructive test of the joint connection. The connections and correlations of the quality variables are thereby used that can be managed by neuronal networks.

Analogous to the online determination of quality variables during the punch riveting of half-hollow punch rivets, this process can also be used for punch riveting of full punch rivets and for clinching. The main process steps for the online determination of the embossing depth $h_d$ and rivet head end position $K_{VS}$ of a full punch rivet with a length L in a punch rivet process with the help of a moveable punch and a die can be summarized as follows: capturing of a path covered by a moveable punch during the punch rivet process with the help of a travel sensor, capturing of a force F applied to the full punch rivet by the moveable punch during the punch rivet process depending on the covered path, determination of an attachment point $x_2$ of the full punch rivet with punch on a joint part and a release point $x_4$ from the captured force/path data, while the release point $x_4$ identifies a release of the punch after the punch rivet process and calculation of the rivet head end position $K_{VS}$ in accordance with $K_{VS}=x_2+L-x_4$ and the embossing depth $h_d$ in accordance with $h_d=t-[x-(x_2+L)]$, while x describes the maximum distance between facing sides of the punch and t a thickness of the joint parts.

In the case of clinching, the following steps are performed for the online determination of the quality variable base thickness $t_b$: capturing of a path covered by a moveable punch during the clinch process with the help of a travel sensor, capturing of a force F applied to a joint part by the moveable punch during the clinch process depending on the path covered, determination of a release point $x_4$ from the captured force/path data, which identified as release of the punch after the clinch process, and the calculation of the base thickness $t_b$ in accordance with $t_b=x-x_4$, while x describes the maximum distance between facing sides of the punch and the die.

BRIEF DESCRIPTION OF THE ACCOMPANYING DRAWINGS

Preferred embodiments of the present invention are explained in greater detailed with reference to the accompanying drawing.

Figure 2:
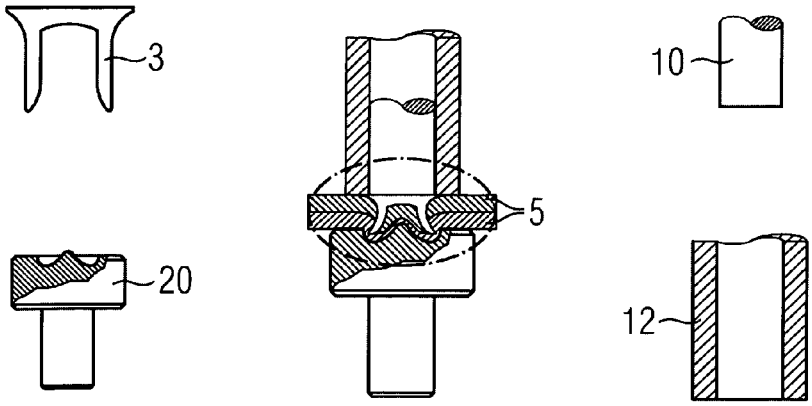
Figure 3:
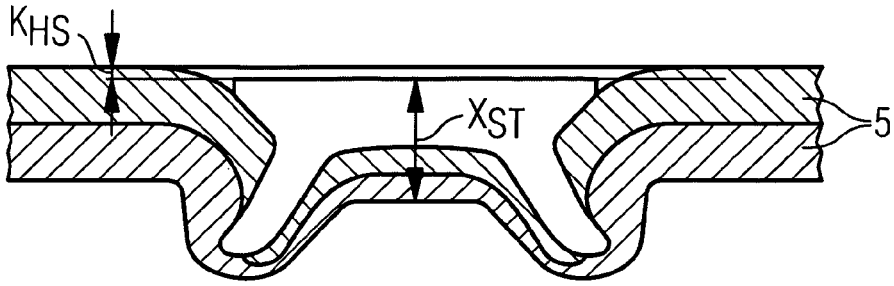
Figure 4:
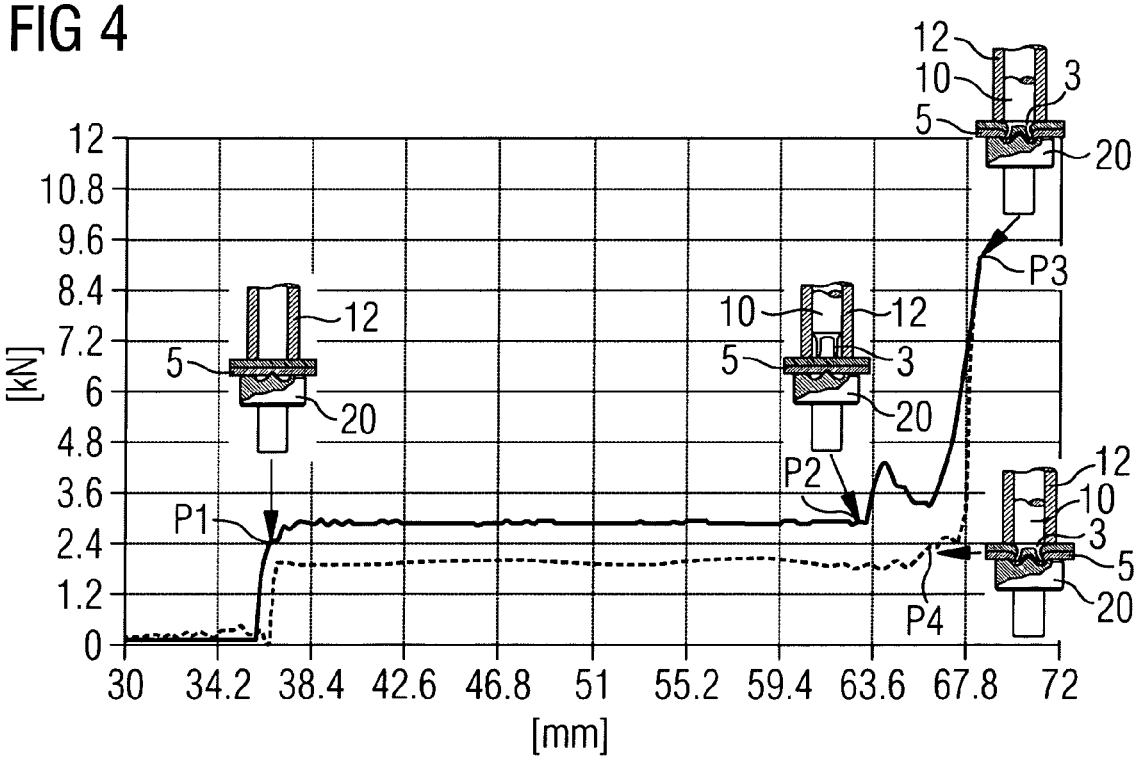

FIG. 1 shows a partially exploded view of an embodiment of an arrangement for the performance of the punch riveting, FIG. 2 shows a schematic partial view of a section from FIG. 1, FIG. 3 shows a representation of the variables rivet head end position $K_{HS}$ and bulge/upset dimension $x_{ST}$ during the joining of a half-hollow punch rivet, FIG. 4 shows a force/path diagram, which contains force/path data recorded during the punch rivet process as well as prominent positions during the joining process of half punch rivets.

Figure 5:
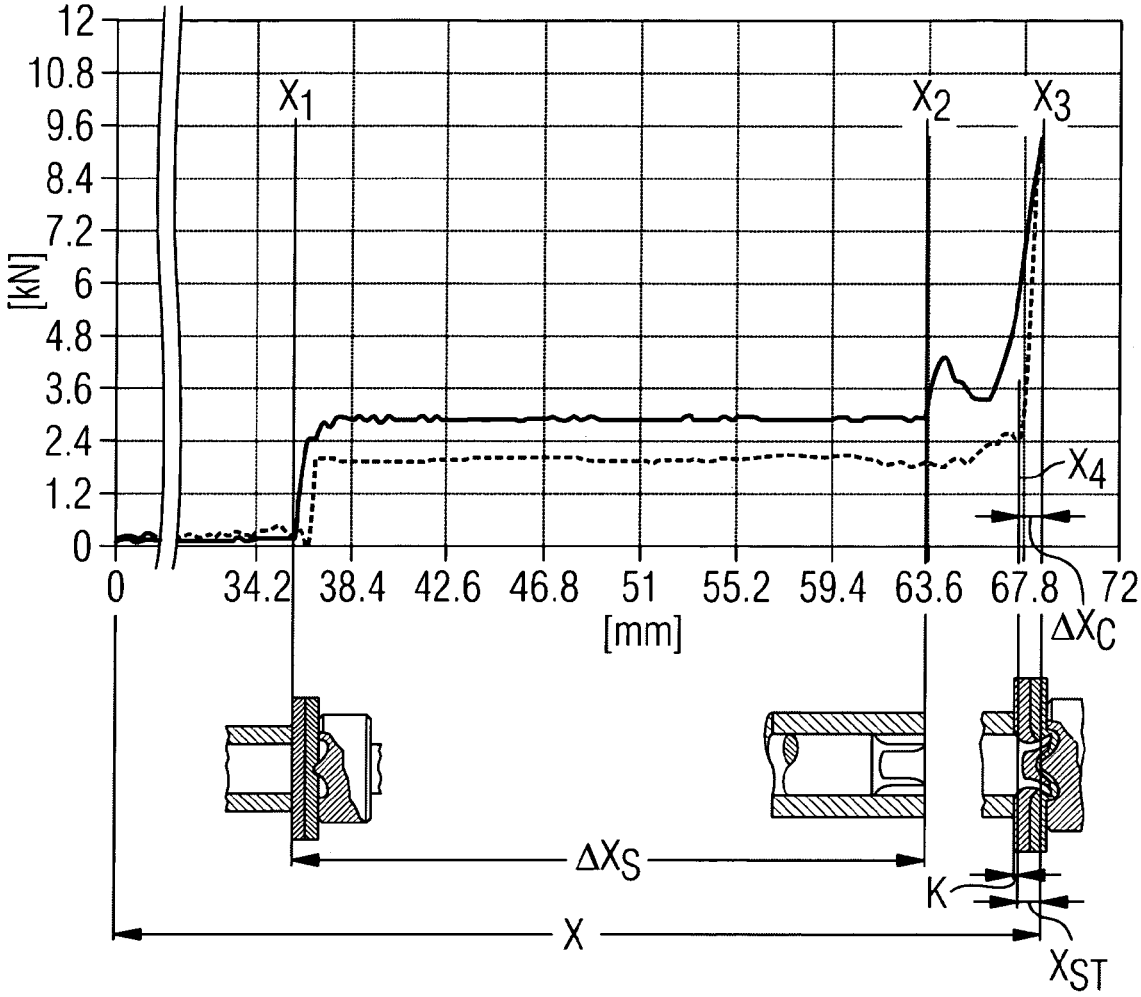
Figure 6:
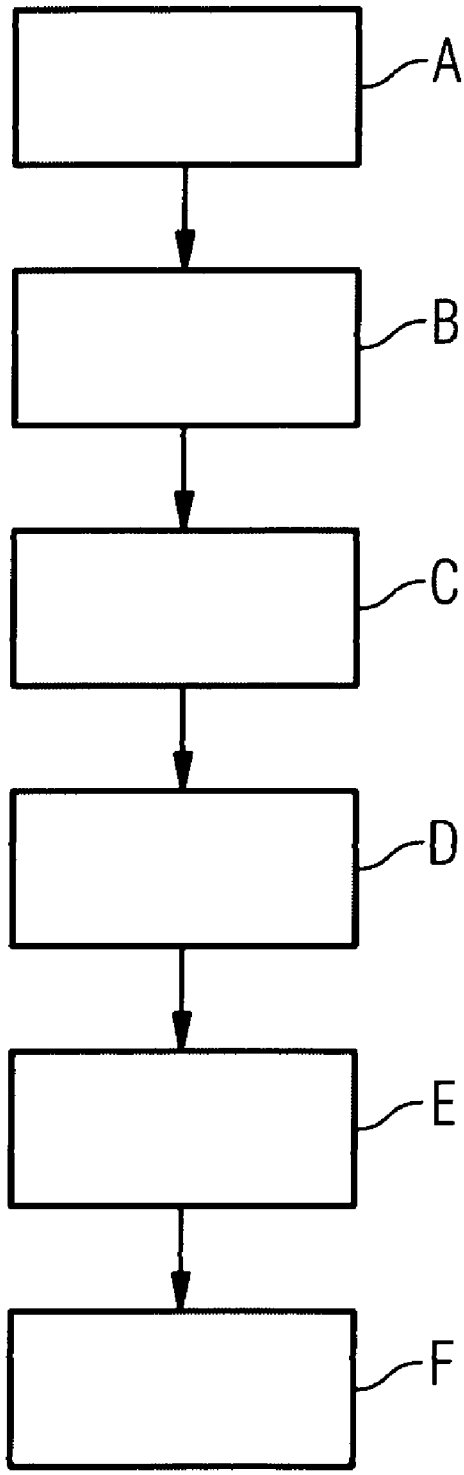
Figure 7:
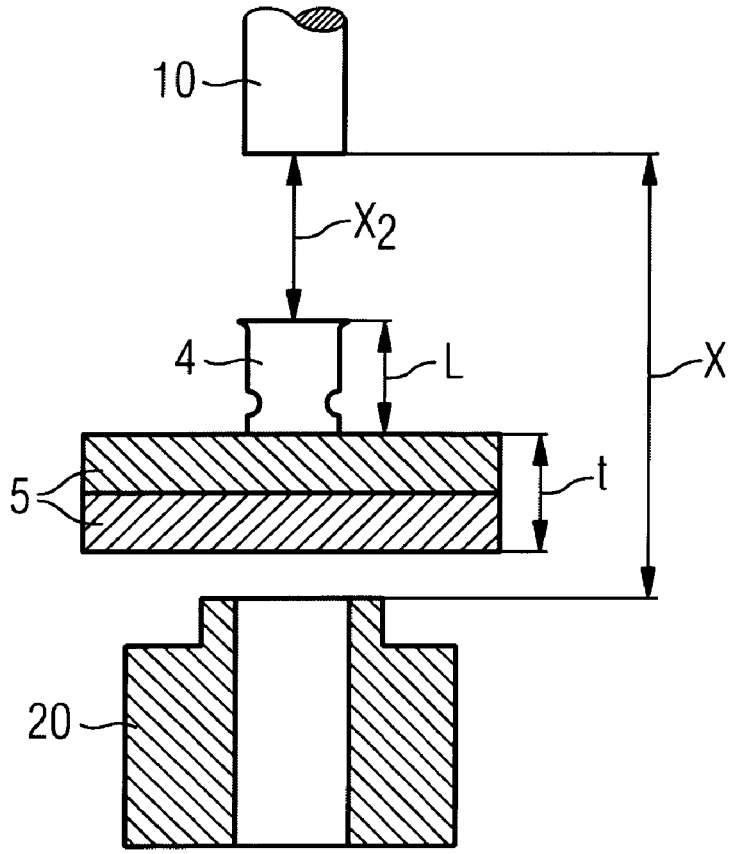
Figure 8:
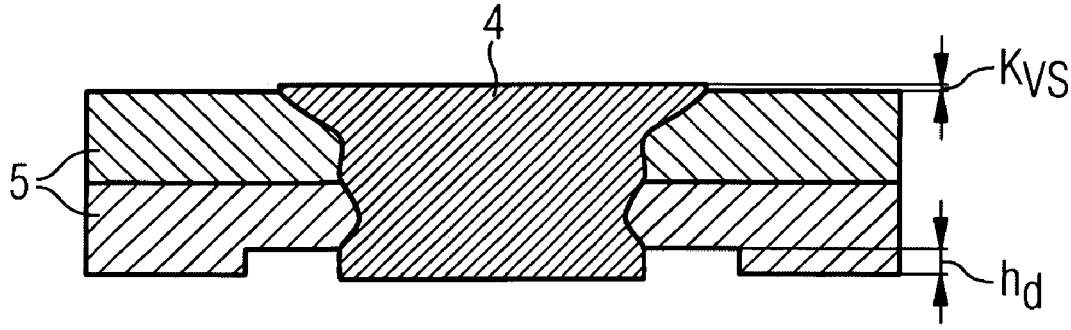
Figure 9:
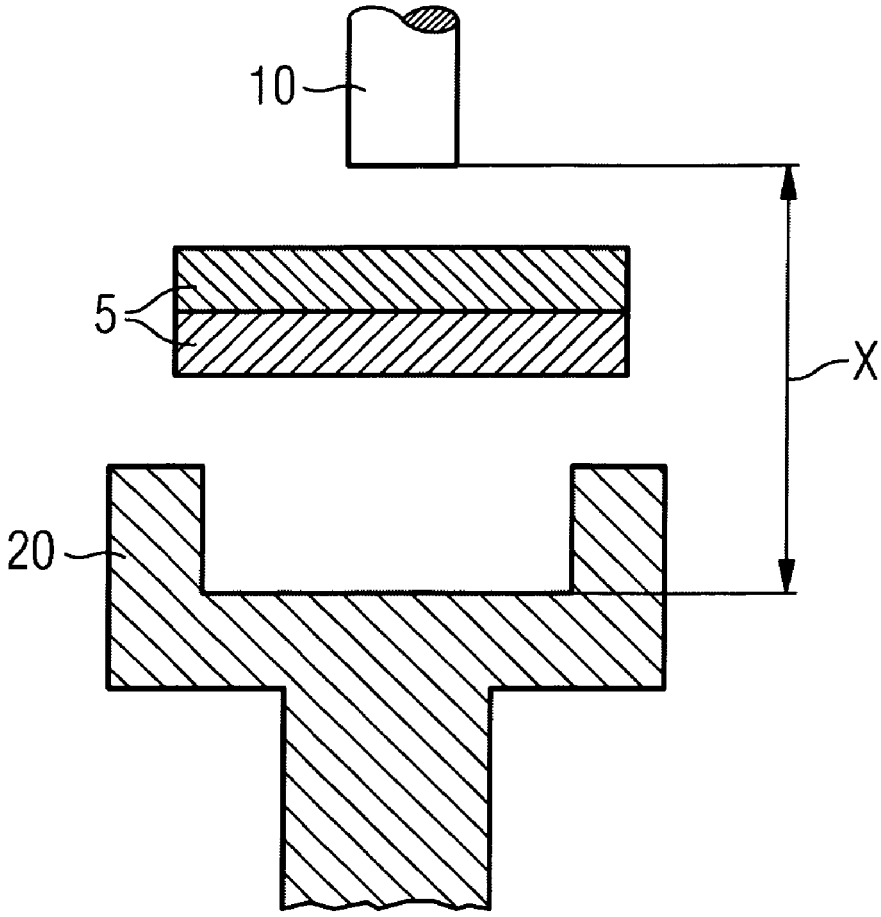
Figure 10:
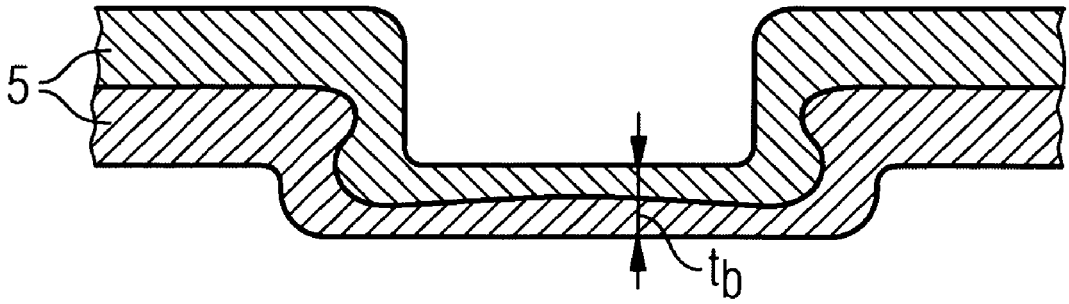

FIG. 5 shows the force/path data of a punch rivet process entered in a force/path diagram as well as the distinctive points of the curve from which different geometric variables result for the quality determination of the produced punch rivet connection, FIG. 6 shows a flow diagram for the representation of the method steps for punch riveting and clinching, FIG. 7 shows a schematic representation of an apparatus for the performance of the full punch riveting, FIG. 8 shows a representation of the variables rivet head end position $K_{VS}$ and embossing depth ha during full punch riveting, FIG. 9 shows a schematic representation of an apparatus for the performance of the clinching and FIG. 10 shows a representation of the variable base thickness $t_b$ during clinching.

DETAILED DESCRIPTION OF PREFERRED EMBODIMENTS OF THE INVENTION

The online determination of bulge/upset dimension $x_{ST}$ and rivet head end position $K_{HS}$ of a rivet is described below based on the example of a punch rivet process of a half-hollow punch rivet. Analogous to the following description, the online determination of quality characteristics for the half-hollow punch rivet can also be applied to punch riveting for a full punch rivet or to clinching (see below).

An exemplary embodiment of a joining device for the punch riveting of a half-hollow punch rivet is shown in FIG. 1. It comprises a punch 10 and a die 20, which are arranged opposite each other with the help of a C frame 30. The force applied by the punch 10 is captured by means of a force sensor 40, for example a load cell (step A in FIG. 6). A travel sensor 50 of the known type captures the path covered by the punch 10 (see step B in FIG. 6). The force data captured by the force sensor 40 and the path data captured by the travel sensor 50 are transferred to a data processing unit 60, for example a computer, and saved there as force/path data of the punch rivet process. In addition to the preferred representation of the force/path data in a force/path diagram (see step C in FIG. 6), the online evaluation of the captured force/path data is generally performed in the data processing unit 60 parallel to the joining process.

FIG. 2 shows schematically an enlarged section from FIG. 1, in which different components of the half-hollow punch rivet are shown. In the case of half-hollow punch riveting, joint parts 5 are first pushed against the die 20 via a set head or hold-down device 12 with a predetermined hold-down force. The punch 10 then moves a half-hollow punch rivet 3 in the direction of die 20 in order to create the joint connection. The path covered by the punch 10 in this movement is captured with the help of the path sensor 50. In the same manner, the force applied to the rivet 3 during the movement of the punch 10 is captured by the force sensor 40. It is also preferred to record the holding forces of the hold-down device 12 for the joint parts 5 via the force sensor 40 and to transfer to it to the force/path data of the joining process to be evaluated later. The force/path data of the joining processing determined in this manner, which include both the approach of the punch 10 up to the pressing of the half-hollow punch rivet 3 into the joint parts 5 (see solid curve in FIG. 4) and the return of the punch 10 and hold-down device 12 to their original positions (see dashed line in FIG. 4), is evaluated online for the joining process in the data processing unit 60.

FIG. 3 shows a schematic cut through the joint connection consisting of half-hollow punch rivet 3 and joint parts 5. The joint connection can be characterized via quality characteristics bulge/set dimension $x_{ST}$ and rivet head end position $K_{HS}$, the geometric meaning of which is represented in a joint connection in FIG. 3. The rivet head end position $K_{HS}$ describes the distance between the rivet head surface of the half-hollow punch rivet 3 and the surface of the joint part 5. The bulge/upset dimension $x_{ST}$ describes the distance between the rivet head surface of the half-hollow punch rivet 3 and the lower surface of the joint part 5 below the half-hollow punch rivet 3.

Analogous to the joining of half-hollow punch rivets, quality characteristics can also be determined online during the joining of full punch rivets and during clinching. FIG. 8 shows a joint connection consisting of joint parts 5 and a full punch rivet 4. This connection is characterized by the rivet head end position $K_{VS}$ as the distance between the rivet head surface of the full punch rivet 4 and the upper surface of the joint part 5. Another quality characteristic is the embossing depth $h_d$, which describes a pressing depth of a die 20 (see FIG. 7) into the bottom joint part 5. Also, the quality characteristic base thickness $t_b$, which is shown in FIG. 10, can be determined online during clinching.

The path signals of the punch 10 are recorded (step A) during the process monitoring of the joining process, i.e. the online determination and evaluation of the aforementioned force/path data. The set head 12 anticipates the punch 10 around the punch stroke length. The set head 12 is first placed on the joint parts 5 and pushes the joint parts 5 onto the die 20. This momentum is represented in the force/path curve of the joining process in accordance with FIG. 4 by point P1, up to which the path x is covered by punch 10. The punch 10 covers the path, which corresponds with the punch stroke minus a length L of the rivet 3, and places the half-hollow punch rivet 3 onto the joint parts 5 (see point P2 in FIG. 4). This point is called the attachment point, which is described by the path $x_2$. In the case of a further increase in the compressive force of the punch 10, the half-hollow punch rivet 3 is pushed into the joint parts 5 and is deformed by the counterforce of the die 20. When a predefined maximum force $F_{max}$ of the joint process or a predefined path of the punch is reached, the half-hollow punch rivet 3 is lowered into the joint parts 5 (see P3 on path $x_3$ in FIG. 4). During this process, the C frame is bent up by the pushing together of the punch 10 and the die 20 based on its elastic material properties and construction. The force/path curve up to point P3 is described by the solid line in FIG. 4 and is called the approach of the punch 10. The return of the punch 10 represented by a dashed line runs from point P3 to a punch force of zero. This return of the punch 10 begins with the reduction of the force applied by the punch 10 so that the bending up of the C frame 30 goes back. During the reduction of the punch force at the beginning of the return, the force of the punch 10 drops linearly until the punch 10 in point P4 along path $x_4$ Only contacts the rivet head surface with a minimum force compared to a maximum force $F_{max}$ during the preceding approach of the punch 10. The path difference between points P3 and P4 can be traced back to the bending up of the C frame 30. After point P4 is reached in FIG. 4, punch 10 and hold-down device or set head 12 move back into their original position.

The aforementioned process can thus be read from the captured force/path data of the joining process. In order to perform the online determination of the quality characteristics bulge/upset dimension $x_{ST}$ and rivet head end position $K_{HS}$, the maximum distance x between the bottom side of the punch 10 and the top side of the die 20, preferably of the die punch, must be known. The variable x results from the construction of the joining device as a constant value. It can be measured manually or it comes from a reference run of the punch 10 up to the contact of the die punch or the die base. The position of the attachment point of the set head x in point P1, of the attachment point of the half-hollow punch rivet $x_2$ in point P2, of the covered punch path $x_3$ upon reaching of the maximum joining force $F_{max}$ in point P3, of the rivet head position $x_4$ after release of the C frame in point P4 are read from the exemplary process curve or the force/path curve shown in FIGS. 4 and 5 or are determined automatically in the data processing unit based on certain mathematical criteria from the force/path data. In order to be able to correctly capture these positions, the travel sensor 50 must be calibrated appropriately.

Referring to FIG. 5, the path $x_1$ up to position P1 can be determined in that the force applied to the punch 10 exceeds a predetermined threshold value at position P1. The exceeding of the threshold value indicates that a compressive force is exerted on the joint parts 5 in the direction of the die 20 by the set head or the hold-down device 12. After the force has reached a preset value, with which the set head or the hold-down device 12 is pushed against the joint parts 5, it is held between points P1 and P3 over a certain path.

During the transition from point P1 to point P2, the punch 10 with the half-hollow punch rivet 3 moves in the direction of the die 20 until half-hollow punch rivet 3 in point P2 contacts the top side of the joint parts 5. The attachment point $x_2$ in point P2 of the punch 10 on the joint parts 5 can be identified via a detection of a missing change in the captured moveable path of the punch 10 despite a punch infeed. The missing path change preferably takes place via a punch infeed from 1 to 20 increments. The preferred path sensor 50 measures for example a measurement range from 0-100 mm, 0-150 mm or 0-200 mm. According to the captured path, it delivers an output signal in a range from 0-10 V. In the case of a resolution of 12 bits, this voltage range is subdivided into 4096 increments. If this is applied to a measurement range of 150 mm, one increment corresponds with a path of 0.036 mm and an output signal of 0.0024 V. In accordance with another alternative, if one uses a digital path sensor with a 16-bit resolution, the measurement range of the path sensor is divided into 65536 increments. In the case of a measurement range of 150 mm, one increment thus corresponds with a path change of 0.00229 mm.

In accordance with another alternative, the attachment point $x_2$ in point P2 in the force/path data can be identified as the path on which the captured force of the punch 10 exceeds the holding force of the set head/hold-down device 12 by a certain threshold value. It is also conceivable to determine the path $x_1$ mathematically from the context $x_1=x_2-$(punch stroke+L), where L is the length of the half-hollow punch rivet. The punch stroke is the distance between the bottom side of the punch 10 and the bottom side of the set head/hold-down device 12.

The path $x_3$ up to point P3 is identified via the reaching of the maximum force $F_{max}$ of the punch 10. This maximum force $F_{max}$ can be set according to the components 3, 5 to be joined before the joining process and is thus known.

The path $x_4$ up to point P4 can be identified as follows (step D) during the return of the punch 10 (see dashed line in FIGS.

4 and 5). In point P3 on path $x_3$, a tangent is created on the almost linearly running return (see dashed curve in FIGS. 4 and 5) so that a deviation of the force/path curve by a predetermine value from the tangent delivers point P4 on path $x_4$. One defines here a threshold value for the maximum permissible path change or the deviation of the path from the tangent with $\Delta x \leqq 1\text{-}20$ increments. If the maximum permissible deviation $\Delta x$ of the tangent is exceeded, this determines point P4 and path $X_4$.

It is also conceivable to read point $x_4$ from the force/path data without showing a curve. In this case, one would assume a linear change in the force/path data during the return of the punch 10 starting at point P3 until it is released. As soon as the assumed linear change in the force/path data deviates from its linearity, this point of the deviation determines the path $x_4$.

In accordance with another alternative, a reference variable $\Delta x_C$ for the rigidity/compliance of the C frame 30 was determined in preliminary tests. With the help of this reference variable $\Delta x_C$, $x_4$ results from the difference between $x_3$ and $\Delta x_C$ in accordance with $x_4=x_3-\Delta x_C$. If $x_3$ and $x_4$ have been determined from the force/path curve, $\Delta x_C$ can also be calculated from the difference between paths $x_3$ and $x_4$ in accordance with $\Delta x_C=x_3-x_4$ (step F).

Based on the variables determined from the force/path data, the bulge/upset dimension $x_{ST}$ and the rivet head end position $K_{HS}$ can be calculated in accordance with the following equations (step E). The bulge/upset dimension $x_{ST}$ results in accordance with $x_{ST}=x-x_4$, where x is the maximum distance between the bottom side of the punch and the top side of the die and $x_4$ is the position of the rivet head after the release of the C frame 30 in point P4.

The rivet head end position $K_{HS}$ results from the equation $K_{HS}=(x_1+\Delta x_s+L)-x_4=x_2+L-x_4$. In this formula, $x_1$ describes the attachment point of the set head 12 on the joint parts 5 in point P1, $x_2=\Delta x_s+x_1$ the attachment point of the half-hollow punch rivet 3 to the joint parts 5 in point P2, L the length of the half-hollow punch rivet 3, $x_4$ the position of the rivet head after the release of the C frame 30 and $\Delta x_S$ the difference between variables $x_2$ and $x_1$ as the covered path $\Delta x_S$ of the punch 10 after the attachment of the set head/hold-down device 12 to the joint parts 5 in point P1 up to the attachment of the rivet 3 in point P2 on the joint parts 5.

Analogous to the aforementioned calculations, the quality characteristics rivet head end position $K_{VS}$ and embossing depth $h_d$ for the punch rivets with full punch rivet and base thickness $t_b$ can also be determined during clinching.

The components for joining a full punch rivet 4 are schematically represented in FIG. 7. The full punch rivet 4 with length L is operated with the help of a punch 10 into the joint parts 5. The joint parts 5 are pushed against a die 20 during the joining. In the same manner as with the joining of the half-hollow punch rivet 3, the force/path data is captured and evaluated during the joining process. The paths $x_2$ up to the attachment point of the punch 10 on the full punch rivet 4 and $x_4$ after release of the punch 10 at point P4 can be detected in the force/route data of the joining with full punch rivet 4, as described in terms of the joining of the half-hollow punch rivet 3 (see FIGS. 4, 5). Furthermore, point P3 with path $x_3$ can be derived from the force/path data upon reaching of the maximum joining force $F_{max}$ as well as the value $\Delta x_C=x_3-x_4$. The rivet head end position $K_{VS}$ can thus be calculated in accordance with $K_{VS}=x_2+L-x_4=x_2+L-(x_3-\Delta x_C)$. The embossing depth $h_d$ results from $h_d=t-[x-(x_2+L)]$, where t is the common thickness of the joint parts 5 at the joint locations (see FIG. 7).

In the case of clinching, which is shown schematically in FIG. 9, a punch 10 pushes the joint parts 5 against a die 20. In this process, the force/path data is captured and evaluated in the same manner as during the joining of half-hollow punch rivets 3. As already described above, the variables $x_3$, $x_4$ and $\Delta x_C$ can be identified in this force/path data. The maximum distance x between the bottom side of the punch 10 and the top side of the die 20 is also known. Based on this, the base thickness $t_b$ is calculated in accordance with $t_b=x-x_4=x-(x_3-\Delta x_C)$ in order to characterize the created clinch connection between the joint parts 5.

We claim:

1. Online determination of bulge/upset dimension $x_{ST}$ and rivet head end position $K_{HS}$ of a half-hollow punch rivet having a length L in a punch rivet process by a moveable punch and a die, comprising the following steps:

a. capturing a path covered by a moveable punch during the punch rivet process with the help of a travel sensor, b. capturing a force F applied to the half-hollow punch rivet by the moveable punch during the punch rivet process depending on the covered path, c. determining an attachment point $x_2$ of the half-hollow punch rivet with punch to a joint part and a release point $x_4$ from the captured force/path data, while the release point $x_4$ identifies a release of the punch after the punch rivet process and d. calculating the rivet head end position $K_{HS}$ in accordance with $K_{HS}=x_2+L-x_4$ and bulge/upset dimension $x_{ST}$ in accordance with $x_{ST}=x-x_4$, where x is the maximum distance between facing sides of punch and die.

2. Online determination according to claim 1, comprising the further steps:

capturing the applied force with a force sensor and storing the force/path data in a data processing unit, in particular a computer.

3. Online determination according to claim 1, comprising the further step:

identifying the attachment point $x_2$ in the force/path data via a detection of a missing change in the captured moveable path despite a punch infeed, preferably a missing change over 1-20 increments during the punch infeed or identifying the attachment point $x_2$ in the force/path data as the path, on which the captured force exceeds a certain threshold value, preferably a holding force of a set head or a hold-down device.

4. Online determination according to claim 1, comprising the further step:

identifying the point $x_3$ as the path, on which the maximum force $F_{max}$ of the punch is reached.

5. Online determination according to claim 1, comprising the further step:

calculating a reference variable $\Delta x_C$ for a machine rigidity in accordance with $\Delta x_C=x_3-x_4$, which specifies the flexibility of the constructive connection between the punch and the die, preferably a C frame.

6. Online determination according to claim 1, comprising the further steps:

representing the captured force/path data in the form of a curve and identifying the point $x_4$ through the creation of a tangent on the almost linearly running force/path data after a maximum force $F_{max}$ of the punch is reached so that a deviation of the force/path data by a specified value from the tangent gives point $x_4$.

7. Online determination of embossing depth $h_d$ and rivet head end position $K_{VS}$ of a full punch rivet having a length L in a punch rivet process by a moveable punch and a die, comprising the following steps:

a. capturing a path covered by a moveable punch during the punch rivet process with the help of a travel sensor, b. capturing a force F applied to the full punch rivet by the moveable punch during the punch rivet process depending on the covered path, c. determining an attachment point $x_2$ of the full punch rivet with punch to a joint part and a release point $x_4$ from the captured force/path data, while the release point $x_4$ identifies a release of the punch after the punch rivet process and d. calculating the rivet head end position $K_{VS}$ in accordance with $K_{VS}=x_2+L-x_4$ and the embossing depth $h_d$ in accordance with $h_d=t-[x-(x_2+L)]$, where x is the maximum distance between facing sides of punch and die and t is a thickness of the joint parts.

8. Online determination of a base thickness $t_b$ in a clinch process by a moveable punch and a die, which has the following steps:

a. capturing a path covered by a moveable punch during the clinch process with the help of a travel sensor, b. capturing a force F applied to a joint part by the moveable punch during the clinch process depending on the covered path, c. determining a release point $x_4$ from the captured force/path data, which identifies a release of the punch after the clinch process and d. calculating the base thickness $t_b$ in accordance with $t_b=x-x_4$, where x is the maximum distance between facing sides of punch and die.

9. Online determination according to claim 8, comprising the further steps:

capturing of the applied force by means of a force sensor and storing the force/path data in a data processing unit, in particular a computer.

10. Online determination according to claim 8, comprising the further step:

identifying the point $x_3$ as the path, on which the maximum force $F_{max}$ of the punch is reached.

11. Online determination according to claim 10, comprising the further step:

calculating a reference variable $\Delta x_c$ for a machine compliance in accordance with $\Delta x_c=x_3-x_4$, which specifies the flexibility of the constructive connection between the punch and the die, preferably a C frame.

12. Online determination according to claim 8, comprising the further steps:

representing the captured force/path data in the form of a curve and identifying the point $x_4$ through the creation of a tangent on the almost linearly running force/path data after a maximum force $F_{max}$ of the punch is reached so that a deviation of the force/path data by a specified value from the tangent gives point $x_4$.

* * * * *